United States Patent [19]

Elser

[11] 4,163,504

[45] Aug. 7, 1979

[54] METAL END HAVING FLUTED END CURL

[75] Inventor: William F. Elser, Toledo, Ohio

[73] Assignee: Owens-Illinois, Inc., Toledo, Ohio

[21] Appl. No.: 858,772

[22] Filed: Dec. 8, 1977

[51] Int. Cl.[2] ..... B65D 7/42; B65D 3/10

[52] U.S. Cl. ..... 220/66; 113/121 R; 220/67; 229/5.6

[58] Field of Search ..... 220/66, 67, 309,310, 220/74; 229/5.6; 113/121 R, 121 A, 121 AA, 121 C, 120 AA, 120 Y, 120 V

[56] References Cited

U.S. PATENT DOCUMENTS

| | | | |
|---|---|---|---|
| 700,578 | 5/1902 | Thompson | 113/120 Y |
| 2,327,454 | 8/1943 | Punte | 229/5.6 |
| 2,343,550 | 3/1944 | Grove | 229/5.6 |
| 2,497,870 | 2/1950 | Dennis | 113/121 A |
| 3,083,663 | 4/1963 | Stuchbery et al. | 220/309 |
| 3,122,116 | 2/1964 | Hogmann et al. | 113/121 A |
| 3,376,997 | 4/1968 | Kutka | 220/67 |
| 3,580,464 | 5/1971 | Griffith | 220/67 |

*Primary Examiner*—Allan N. Shoap

*Attorney, Agent, or Firm*—Richard B. Dence; Myron E. Click; David H. Wilson

[57] ABSTRACT

A loose metal end for forming a seamed can end closure and which includes an annular marginal seaming panel having a radiused outer rim concluding in a curled end underlying the seaming panel and provided with a peripherally interspaced array of radially extending flutes shaped to crest directionally towards the seaming panel. When double-seamed onto a can body, the fluted curled end is folded into a fluted hook end with the flutes cresting radially outward and away from the can body. As thus disposed, the flutes provide preselectively located sites which function to direct such "pinwrinkles" or "pinlips", as may result from buckling compressive forces generated in the hook end during the seaming or crimping operations, to project radially outward and away from the can body.

10 Claims, 5 Drawing Figures

METAL END HAVING FLUTED END CURL

BACKGROUND OF THE INVENTION

1. Field of the Invention

The present invention pertains to double-seamed can ends and to loose metal can ends for double-seamed assembly on the open end of a can body such as a lightweight or thin-walled metallic or laminated, fiber-type composite can body which is relatively susceptible to perforation, penetration or puncture induced by radially inward buckling, pinlipping or pinwrinkling, of the hook end of the closure seaming wall against the can body during seaming or crimping of the loose metal end into assembly with the can body.

2. Description of the Prior Art

In the past, it has been conventional practice in the packaging field to manufacture metallic cans for the storage of comestibles, beverages and other various products. Customarily, such cans have comprised a tubular open-ended can body fabricated from metal sheet material having a thickness of about 0.008 inch and greater. Also, such can bodies commonly have been provided with an end closure which is double-seamed onto an outwardly flanged end portion provided at one or both opposite ends of the can body. Such double-seaming has been a favored form of assembling can end closures since it is readily adaptable to production line manufacturing capabilities and at the same time provides a reliable hermetic seal capable of withstanding substantial pressure differentials which may exist, or be encountered, between the ambient atmosphere and the interior confines of the filled container either during processing of the container's contents or during subsequent shipment and storage.

Due in large part to material, manufacturing and shipping cost considerations, a continually growing effort has evolved in the packaging field to provide lighter weight and less expensive cans for packaging an ever increasing variety of substances. In so far as metallic cans are concerned, this effort has evolved the emergence of thin-walled can bodies fabricated from light gauge metals such as aluminum and tin-plate. Moreover, such lightweight and thin-walled metallic cans now have attained substantial acceptance for packaging substances which require the development of internal pressures within the can such as, for example, are encountered in canning processes requiring sterilization of the can's contents or for packaging pressurized substances such as carbonated beverages and pressurized liquid spray materials. This trend towards less expensive and lighter weight cans has also engendered an alternative development and expanding usage of can bodies constructed from other various lightweight and relatively inexpensive materials such as plastic cans and laminated fiber-type cans commonly referred to as "composite cans". Such composite cans ordinarily include a tubular body portion fabricated from coated or uncoated fibrous materials, or composite interlayers of fibrous materials together with other compatible interlayer materials such as plastic and/or foil liners which assist in providing suitable gaseous or liquid impermeability, or in providing other physical characteristics dictated by the nature of the particular substance to be packaged and stored within the composite can.

As with the predecessor heavier gauge metal can bodies, it is still highly desirable to employ double-seamed end closures with thin-walled, lightweight metallic, plastic and composite can bodies to provide a reliable hermetic seal which is protective of the can's contents. This is especially desirable with respect to packaging comestibles, perishable products and most certainly carbonated beverages, pressurized liquids, and products which are heat-sterilized subsequent to packaging. However, the employment of double-seamed end closures with thin-walled, lightweight metallic, or plastic, or composite cans has been found to present a problem which was either insignificant or generally non-existant with heavier gauge metallic can bodies. In this regard, there is a common and natural tendency for the inwardly bent end, or hook end, portion of a double-seamed, metal can end to buckle radially inward and form sharp-edged, projections, or pointed barbs, at various random peripheral locations as the hook end is being peripherally constricted in size in consequence of being seamed, or crimped, into inter-locked, hermetic assembly with the can body. Due to the reduced wall thickness of lightweight metallic can bodies and the relative softness of plastic and composite can bodies, as compared with former heavier gauge metallic can bodies, the sharp-edged or pointed projections resulting from such buckling, commonly referred to in the art as "pinwrinkling" or "pinlipping", often partially penetrate or completely puncture the body portion of a lightweight metallic, or plastic, or composite can and thereby render it unsafe or unsuitable for packaging use. As a consequence, it has become highly desirable to attempt to obviate pinwrinkling or pinlipping as a source of can damage during the seaming operation. This desirability is particularly significant, since such can damage ordinarily occurs as one of the last stages of the can assembly and frequently after the can has been filled with its intended contents. Thus, the labor and material costs involved in filling and assembling the can are lost and not subject to recovery.

SUMMARY OF THE INVENTION

The present invention pertains to a double-seamed can end for can bodies and like containers. The can end is especially structured to render it particularly suitable for use with lightweight, thin-walled metallic can bodies, as well as with plastic or composite can bodies which offer only relatively limited resistance to body wall penetration or puncture caused by the occurrence of pinwrinkling or pinlipping in the form of sharp edges, barbs, burrs, projections, or the like, which are formd while the can end is being forcefully seamed or crimped against the wall of the can body. The innovative structural features of the can end include the formation of preformed stress relief regions which are designed to cause such buckling, pinwrinkling, or pinlipping, as may occur during the seaming operation to be directed radially outward and away from the can body. Such stress relief regions are provided in the form of a peripherally interspaced array of flutes which are preformed in the hook-forming, curled end of the loose metal can end prior to assembly on the can body. The flutes are structured in such manner that they crest radially outward and away from the can body during the seaming or crimping operation and thereby provide a peripheral array of directionally predefined stress relief paths which are likewise directed radially outward and away from the can body. Thus, such buckling, pinwrinkling, or pinlipping, as may result from the constriction of the curled end during the seaming operation is induced to occur in the fluted regions and to be directed radially outward and away from the can body.

Accordingly, a primary objective of the present invention is to provide a metal can end which is designed to avoid damage to a thin-walled metal, plastic or composite can body during seaming of the can end onto the end of the can body.

Another objective of the present invention is the provision of a can end which is provided with means for inducing pinwrinkles, pinlips, or the like, occurring during seaming of the can end on a can body to form in a direction projecting away from the can body.

A further objective of the present invention is to provide a loose metal can end which is structured in such manner as to be capable of accomplishing the last-mentioned objective without necessitating modification of equipment and procedures conventionally utilized for double-seaming of loose metal can ends or can bodies.

A further and more particular objective of the present invention is the provision of a loose metal can end with a marginal seaming panel having a radiused outer rim concluding in a curled under end which is characterized by having a peripherally interspaced array of radially extending flutes cresting directionally towards the seaming panel and providing selectively and directionally predefined stress relief paths for directionally inducing pinwrinkles and pinlips to form directionally away from a can body when the loose metal end is seamed thereon.

The specific nature of the present invention together with these and other additional objectives, features and advantages thereof, will become readily apparent to those ordinarily skilled in the art from the following detailed description taken in conjunction with the annexed sheets of drawings on which, by way of illustrative example, a preferred embodiment of the present invention is depicted.

BRIEF DESCRIPTIONS OF THE DRAWINGS

FIG. 1 is a perspective view depicting a can body having each of its opposite ends tightly closed and seamed to a metal can end embodying the features of the present invention; and FIG. 2 is an enlarged fragmentary perspective view of a preformed, loose metal can end prior to its being seamed onto a can body and having the features of the present invention embodied therein; and FIG. 3 is an enlarged fragmentary perspective view of the loose metal can end shown in FIG. 2 after initial positioning thereof upon the open end of a can body preparatory to being seamed into assembled relationship with the can body; and FIG. 4 is a view similar to FIG. 3, but depicting the completed can after the loose metal can end has been double-seamed into finalized assembly as a can end closure on the can body; and FIG. 5 is a fragmentary, sectional view taken along and in the direction of the sectional plane 5—5 in FIG. 4 and more clearly portraying the structural and functional features of the present invention subsequent to seaming of the loose metal end on the can body.

DETAILED DESCRIPTION OF THE INVENTION

With reference to the drawings, the present invention is, for illustrative and descriptive purposes only, depicted as being embodied in a metal can end for a fiber-type composite can. However, it will be readily apparent and manifestly clear from the ensuing description that the present invention imparts similarly advantageous and beneficial features for can ends for other various types of containers, and especially containers constructed with thin-walled metallic or plastic can bodies which are subject to puncture or weakening penetrative wall damage resulting from pinwrinkling or pinlipping during seaming of preformed loose metal ends onto the can bodies.

Figure 1:
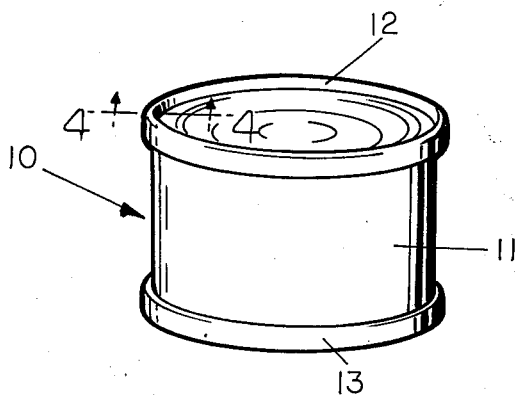

Keeping the foregoing in mind, there is generally shown in FIG. 1 a closed and hermetically sealed fiber-type composite container, or can 10, having an axially extending, hollow, fiber-type, cylindrical can body 11 closed at one end by a can end closure 12 at the other end by a similar can end closure 13 which are, respectively, tightly seamed onto the can body to provide a hermetically sealed environment within the hollow confines of the can. Although both opposite ends of the can body are shown as being similarly closed by similar seamed can end closures, it is to be understood that the benefits and advantages of the present invention are also applicable to various types of cans which only utilize or require one such can end closure. Illustrative of the letter types of cans are drawn metal cans, or plastic cans, formed with a one-piece sidewall and bottom wall construction, as well as other various types of cans having one of the opposite ends suitably closed or sealed by some other form of end member.

Figure 2:
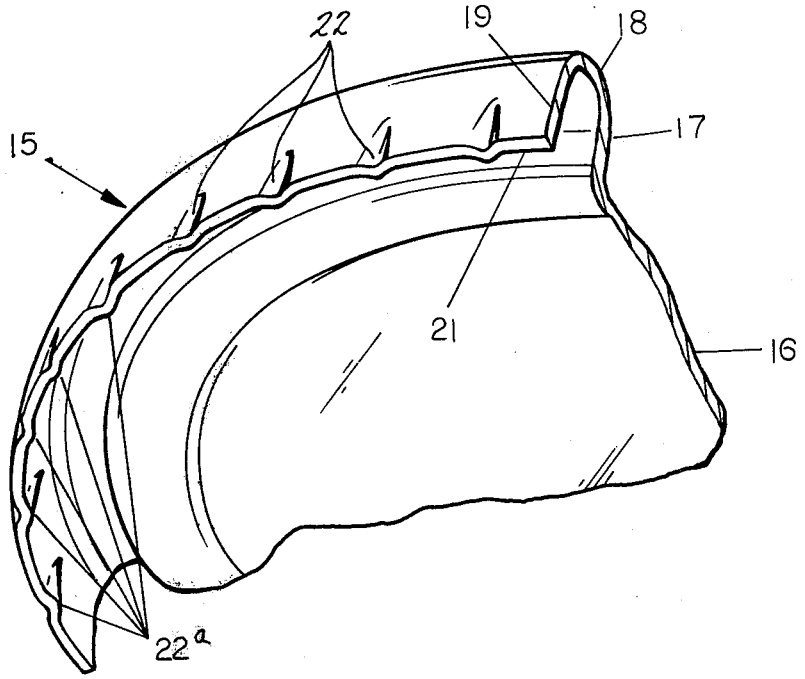

As is customary and commonly-known in the art, metal end closures, such as the top and bottom can ends 12 and 13 shown in FIG. 1, are intially fabricated into preformed loose metal ends which are shaped and dimensioned to conform to particular and commonly standard specifications tailored to the particular size, end shape, and type of can body onto which the loose metal ends are to be assembled and seamed. As best depicted in FIG. 2, the loose metal end 15 most commonly possesses a generally circular overall peripheral configuration tailored to correspond to the conventional cylindrical configuration of the preponderance of can body shapes customarily employed for various packaging purposes. It is to be understood, however, that in accordance with the present invention the loose metal end 15 may partake of other various alternative peripheral configurations adapted to conform to the requirements of cans, or containers, having alternative end shapes such as ovular-shaped or multi-sided ends, or the like. As fragmentarily shown, the loose metal end 15, generally includes a central panel 16 marginally encompassed by an integral, annular seaming panel 17 having a peripherally depending, curled outer rim 18 defining a convexly and uniformly radiused, cross-sectional configuration and concluding in a radially inwardly curled end 19 having an innermost terminal edge 21. As thus shaped, the outer rim 18 defines a rounded, generally toric, outside peripheral configuration having an essentially uniform maximum outer diameter. To the extend described with respect to FIG. 2, the loose metal end 15 structurally corresponds generally to prefabricated loose metal ends conventionally employed for subsequent seaming into metal end closures, such as the end closures 12 and 13 shown seamed on the can body 11 in FIG. 1.

In accordance with the present invention and contrary to the conventional structure of loose metal ends wherein the curled end is essentially smoothly surfaced throughout its peripheral entirety and terminates in an essentially planar edge, the loose metal end 15 of the present invention is provided with means designed to effectively obviate can body damage caused by the formation of burrs, spurs, or similar common forms of sharp or pointed projections, or protrusions, which are commonly referred to in the art as pinwrinkles or pinlips. The formation of such pinwrinkles, or pinlips, results as a consequence of the natural tendency of the curled end 19 to buckle, especially in the vicinity of its terminal edge 21, while being forcefully constricted and compressed during subsequent seaming of the loose metal end 15 onto a can body. As shown, means for obviating can body damage caused by pinwrinkles, or pinlips, are provided in the form of a peripherally interspaced array of substantially identically shaped flutes 22 reoccurring at substantially equally interspaced intervals along the periphery of the terminal edge 21 and the otherwise essentially smoothly surfaced curled end 19. The flutes 22 are respectively shaped to form a summit or crest **22*a* disposed to face directionally towards the annular seaming panel and interior confines of the curled outer rim 18**.

Figure 3:
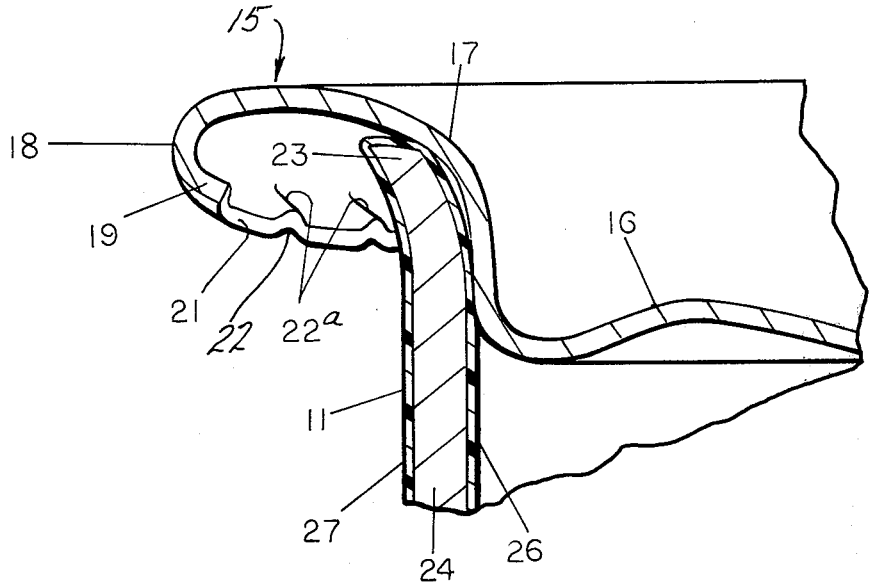

As observed in FIG. 3, the loose metal can end 15 is, in accordance with conventional practice, initially snugly seated in slightly recessed position within the open end of the can body 11 with the central panel 16 arranged to span the open end and with the seaming panel 17 extending radially outward over the outwardly flanged rim 23 of the can body. The can body 11, although depicted in a preferred form as a laminated fiber-type can body, may, as previously indicated, also be fabricated from lightweight metal or plastic. In the preferred form shown, the fiber can body 11 may, for example, be constructed as described in U.S. Pat. No. 3,580,464 and may comprise a layer of structural material 24 built up from a plurality of sheets of can stock grade natural kraft linerboard and sandwiched between an inner liner 26 of aluminum foil and paper laminate, or the like, and an outer paper or plastic liner, or label 27.

Figure 4:
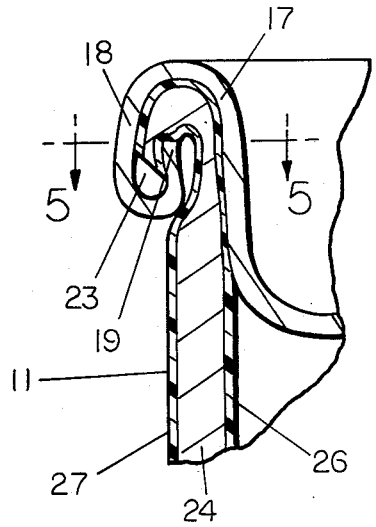

In accordance with conventional practices and procedures known and employed in the art, the loose metal end 15 is then tightly seamed, as by double-seaming, onto the end of the can body 11, as shown in FIG. 4. As thus seamed, the marginal seaming panel 17 assumes a position folded downward and inward from the position shown in FIG. 3, and in which position the outwardly flanged rim 23 of the can body 11 is folded downward and inward and caused to be tightly sandwiched, or crimped, between the outer rim 18, or end chine, and the curled end 19, or cover hook, which, in turn, is tightly crimped against the sidewall of the can body 11. Thus, when double-seamed, the outer rim 18 of the marginal seaming panel 17 forms an outer seaming wall and the curled end 19 forms an inner seaming wall disposed in substantially concentrically interspaced relationship within the outer seaming wall and integrally interconnected with the latter by an intermediate generally U-shaped bend. The outwardly flanged rim 23 of the can is tightly crimped or sandwiched between the outer and inner seaming walls in interlocking seamed relationship to provide a hermetic seal between the resultant can end closure and can body 11. The seaming operation, of course, involves a substantial circumferential constriction of both the outer rim 18 and the curled end 19 of the loose metal can end. As a natural resulting tendency of the compressive forces and stresses induced by such constriction, the curled end 19 tends to buckle, especially in the vicinity of the innermost terminal edge 21. In the absence of the fluted construction of the present invention, such buckling frequently produces pinwrinkles, or pinlips, which project radially inward towards the can body 11 in the form of sharp projections, burrs, barbs, or the like, which forcefully bear against and frequently penetrate or puncture the wall of the can body.

Figure 5:
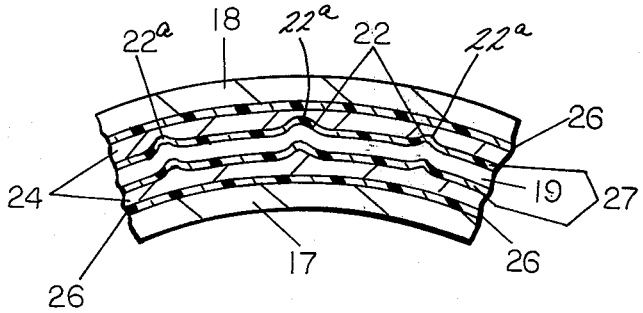

As best shown in FIG. 5, such buckling problems are, in accordance with the present invention, effectively obviated by the provision of the fluted construction of the curled end 19. By virtue of such construction, the peripherally interspaced flutes 22, both during and following the seaming of the loose metal end, project, or crest, radially outward from the can body 11. Functionally, the respective flutes 22 provide selectively predetermined, or predefined, locations of directionally controlled, weakened resistance to buckling forces and stresses occurring during subsequent seaming of the loose metal can end 15 onto a can body. Otherwise stated, the flutes 22 induce such pinwrinkling, or pinlipping, as may occur to be selectively directed radially away from the can body 11 and to be formed in the radially outwardly facing crest region of the flutes.

Although the most effective interspacing and height of the flutes will be influenced considerably by various factors such as, among others, the particular type temper and thickness of the metal fabricating material, and also the peripheral size of the loose metal end, the flutes should be comparatively closely spaced and of sufficient height to provide relatively uniform peripheral deployment of the constrictive stresses developed around the entire terminal edge 21 of the curled end 19 during the seaming operation. Typically, for a circular, loose metal can end the recommended number of flutes ordinarily should not be less than about 9 flutes per inch of maximum diameter of the radiused outer rim 18. Ordinarily, between about 9 and 15, and more preferably between about 10 and 12.5, substantially equally interspaced flutes per inch of maximum diameter of the curled outer rim will effectively preclude the occurrence of damaging pinwrinkling or pinlipping. The term "maximum diameter" of the loose metal end, of course, is intended by conventional definition to mean the maximum outer diameter of the curled outer rim 18 prior to seaming. Although the flutes may vary somewhat in height, particularly good results have been obtained by maintaining the flute heights in the range of about 0.75 and 1.25 times the thickness of the loose metal end. The lengths of the flutes similarly may vary, but preferably should be in the dimensional range of about 1.0 and 1.3 times the outside radius of curvature of the curled outer rim of the loose metal end.

As an illustrative example, a group of 401 diameter 75 pound tinplate loose metal can ends having an 0.0083 inch metal thickness and meeting the recommended dimensional industry specifications set forth in Bulletin E-401.1 (January 1969) of the National Fibre Can and Tube Association were provided with fluted curl ends in the manner shown and described with respect to the present invention. Following double-seaming of the loose metal ends onto fiber can bodies in conventional manner, the resultant double-seamed can end closures were tested and evaluated. The results of these tests and evaluations indicated that ideal results were obtained with flutes peripherally interspaced at intervals in the range of between about 0.25 and 0.3125 inch and formed with heights in the range of between about 0.006 and 0.008 inch. These tests further demonstrated that can damage resulting from pinwrinkling, or pinlipping, was effectively eliminated, whereas in the absence of such fluting severe can damage tended to occur.

In view of the foregoing, it is manifest that the present invention incorporates novel structural features which effectively obviate can damage commonly arising from pinwrinkling, or pinlipping, of metal can ends during the seamed attachment thereof onto lightweight metal, plastic or fiber can bodies.

It will, of course, be understood that various details of construction, combination and assembly may be modified throughout a range of equivalents, and it is, therefore, not the purpose to limit the scope of the present invention otherwise than as necessitated by the scope of the appended claims.

I claim:

1. A loose metal can end for use in forming a seamed can end closure for a can body, said loose metal can end including a central panel marginally encompassed by a marginal seaming panel having a peripherally depending curled outer rim defining a convexly radiused cross-sectional configuration and concluding in a radially inwardly curled end, said curled end including means preformed therein for inducing said curled end to pinwrinkle directionally away from said can body when said loose metal can end is subsequently seamed onto the end thereof, said means comprising a peripherally interspaced array of flutes respectively cresting directionally towards the interior confines of said outer rim, and said curled end with the exception of said flutes being otherwise essentially smoothly surfaced throughout the peripheral entirety thereof.

2. A loose metal can end as defined in claim 1, wherein said flutes are substantially equally interspaced and substantially identically shaped.

3. A loose metal can end as defined in claim 1, wherein said outer rim defines a generally toric peripheral configuration having an essentially uniform maximum outer diameter.

4. A loose metal can end as defined in claim 3, wherein the number of flutes in said curled end is not less than 9 flutes per inch of maximum diameter of said outer rim.

5. A loose metal can end as defined in claim 4, wherein said flutes have a height dimension which is in the range of about 0.75 and 1.25 times the metal thickness of said loose metal can end.

6. A loose metal can end as defined in claim 5, wherein said outer rim is uniformly radiused and wherein said flutes have a length dimension in the range of about 1.0 to about 1.3 times the dimensional radius of outside curvature of said outer rim.

7. A loose metal can end as defined in claim 3, wherein the number of flutes in said curled end is between about 9 and 15 flutes per inch of maximum diameter of said outer rim.

8. A loose metal can end as defined in claim 3, wherein the number of flutes in said curled end is between about 10 and 12.5 flutes per inch of maximum diameter of said outer rim.

9. In the combination including a hollow can body having an axially extending body wall terminating in an outwardly flanged rim surrounding said body wall, a can end closure double-seamed with said flanged rim and closing the end of said can body, said can end closure having a marginal seaming panel comprising an outer seaming wall integrally interconnecting with an inner seaming wall disposed in substantially concentrically interspaced relationship within said outer seaming wall, said outer and inner seaming walls being radially constricted and sandwiching said flanged rim tightly therebetween in hermetically sealed and interlocking seamed relationship, the improvement wherein said inner seaming wall of said can end closure includes means preformed therein for inducing pinwrinkles caused by subsequent constriction of said inner seaming wall to project directionally away from said can body, said means comprising a peripherally interspaced array of flutes defined in said inner seaming wall and respectively cresting directionally towards said outer seaming wall, and said inner seaming wall being essentially smoothly surfaced between each of said flutes.

10. The combination as defined in claim 9, wherein said can body is a laminated fiber-type can body.

* * * * *